United States Patent [19]

Petty, Jr.

[11] Patent Number: 4,901,867

[45] Date of Patent: Feb. 20, 1990

[54] COLLAPSIBLE WIRE RACK

[75] Inventor: O. L. Petty, Jr., Cameron, Tex.

[73] Assignee: Royal Seating Corporation, Cameron, Tex.

[21] Appl. No.: 223,347

[22] Filed: Jul. 25, 1988

[51] Int. Cl.[4] ..... A47F 7/16

[52] U.S. Cl. ..... 211/46; 312/184

[58] Field of Search ..... 211/46, 45, 181, 195, 211/184; 220/22.5; 312/187, 184

[56] References Cited

U.S. PATENT DOCUMENTS

| | | | |
|---|---|---|---|
| 2,529,267 | 11/1950 | Sloane | 211/181 X |
| 3,114,459 | 12/1963 | Kersting | 211/181 X |
| 3,848,748 | 11/1974 | Ceccarelli | 211/181 X |
| 4,231,175 | 11/1980 | Baxter | 211/181 X |
| 4,508,230 | 4/1985 | Ashton | 211/181 |
| 4,616,756 | 10/1986 | Holtz | 211/181 |

*Primary Examiner*—Reinaldo P. Machado
*Assistant Examiner*—Sarah A. Lechok
*Attorney, Agent, or Firm*—James C. Fails; Arthur F. Zobal; Geoffrey A. Mantooth

[57] ABSTRACT

What is disclosed is a collapsible wire rack characterized by two substantially identical and planar ends for receiving a bottom; a pair of horizontal wire members having at both ends a bent hook eye structure for pivotally receiving respective side end wire members to allow collapsibility; the horizontal wire members being affixed to the rectangularly shaped centerpiece; two substantially identical planar sides; more elongate member defining a more supporting top; four sets arranged one at each end of each side of three shortened vertical wire members, two of each set being bent in a U-shaped configuration for carrying a nut means for screwingly, removably receiving a threaded shaft of a caster; and one of each set having a bent hook structure adjacent its lower end and disposed substantially level with the bent hook structure of the vertical wire member of each end for receiving the bottom; a plurality of substantially horizontal wire members connected with the elongate rectangularly shaped centerpiece and the respective sets adjacent each end for greater strength without interfering with the collapsibility of the wire rack; a plurality of adjustable and removable cross members that each have at each end a bent hook structure for hooking over the top to suspendingly hold in place a computer printout or the like; bottom comprising an elongate rectangularly shaped wire structure adapted to removably fit interiorly of the ends and sides in normal operation and be received within the bent hook structures of the vertical wire members; the wire bottom having sufficient diagonal bracing to impart rigidity to the collapsible wire rack when in place and to be removed to allow the wire rack to be collapsible for shipping, storing and the like. Also disclosed are preferred specific embodiments.

9 Claims, 5 Drawing Sheets

COLLAPSIBLE WIRE RACK

FIELD OF THE INVENTION

This invention relates to office furniture. More particularly, it relates to collapsible office furniture that can be employed for holding top mounted office work product, such as computer printouts and the like.

BACKGROUND OF THE INVENTION

The prior art is replete with a wide variety of different types of office furniture. The advent of the computer and the printouts from the computer have generated an interest in a whole series of different approaches to office furniture. These different approaches have included the ergonomic groupings or elements that tend to save money and reduce the work done by the staff, or make more efficient the way the work is done.

One of these ergonomic elements is a basket for holding as in a top mounted file, computer printouts or the like and being made portable so that the computer printout or the like can be rolled around to the various personnel who might be interested in the information thereon.

One of the defects of the prior art type baskets has been that they are bulky and require a great deal of space for storage or shipment, in the latter case involving large containers such as boxes or the like.

More specifically, it would be desirable if the prior art had provided a basket for computer printouts or the like that had the following features not heretofore provided:

1. The basket should be lightweight and able to be collapsed into a relatively small volumetric space for storage or shipment.
2. The basket should be economical, easy to put produce, yet durable in use when moved between various personnel by unskilled labor.
3. It is desirable that the basket be portable in the sense of being easily moved between personnel who may be interested in information contained in the basket, since the basket will not remain in one place like a file cabinet or the like.
4. It is desirable that the basket have construction features that facilitate manufacture, assembly and even disassembly and storage or shipment.

SUMMARY OF THE INVENTION

Accordingly, it is an object of this invention to provide a basket that satisfies at least one of the objects delineated hereinbefore as desirable and not heretofore provided.

Specifically, it is an object of this invention to provide a collapsible wire rack that will serve as a basket and has substantially all of the features delineated hereinbefore and desirable and not heretofore provided by the prior art.

These and other objects will become apparent from the descriptive matter hereinafter, particularly when taken in conjunction with the appended drawings.

In accordance with this invention, there is provided a collapsible wire rack for holding computer printouts and the like comprising in an operational position two substantially identical ends each being substantially planar and formed of wire and including:

a. a rectangularly shaped centerpiece having jointed together two horizontal wire members and two vertical wire members;

b. a pair of substantially vertical wire members having bent hook structure at their respective lower ends for receiving a bottom; said vertical wire members being affixed to the rectangularly shaped centerpiece at each crossing thereof and being adapted to removably receive the bottom;

c. a pair of horizontal wire members having at both ends thereof a bent hook-eye structure for pivotally receiving respective side and wire members to allow for collapsibility; the horizontal wire members being connected with other elements of the end;

two substantially identical sides, each being substantially planar and formed of wire and including:

d. an elongate rectangularly shaped centerpiece having joined together two horizontal wire members and two vertical wire members; having upper, more elongate members defining a supporting top;

e. two sets arranged one at each end of each side of three shortened vertical wire members two of each set being bent in a U-shaped configuration for carrying a nut means for screwingly, removably receiving a threaded shaft of a caster; and one of each set having bent hook structure adjacent its lower end and disposed substantially level with the bent hook structure of the vertical wire members of each of the ends for sealing the bottom; said sets of three shortened vertical wire members being connected with other elements of said side;

f. a plurality of substantially horizontal wire members connected with the elongate rectangularly shaped centerpiece and the respective sets adjacent each end for greater strength without interfering with the collapsibility of the wire rack;

a plurality of adjustable and removable cross members that each have at each end a bent hook structure for hooking over the top to suspendingly hold in place a computer printout or the like; and a bottom comprising an elongate rectangularly shaped wire structure adapted to removably fit interiorly of the ends and sides in normal operation and be received within the bent hook structures of the vertical wire members; the wire bottom having sufficient diagonal bracing to impart rigidity to the collapsible wire when emplaced and to be removed to allow the wire rack to be collipsible for shipping, storing and the like.

Preferred embodiments are specifically disclosed.

DESCRIPTION OF THE PREFERRED EMBODIMENTS

This invention has the flexibility being used in a wide variety of applications. It was designed for the specific application of holding computer printouts or the like so they could be readily retrieved and viewed by personnel interested in their information, so it is in this context that the invention will be described hereinafter.

Figure 1:
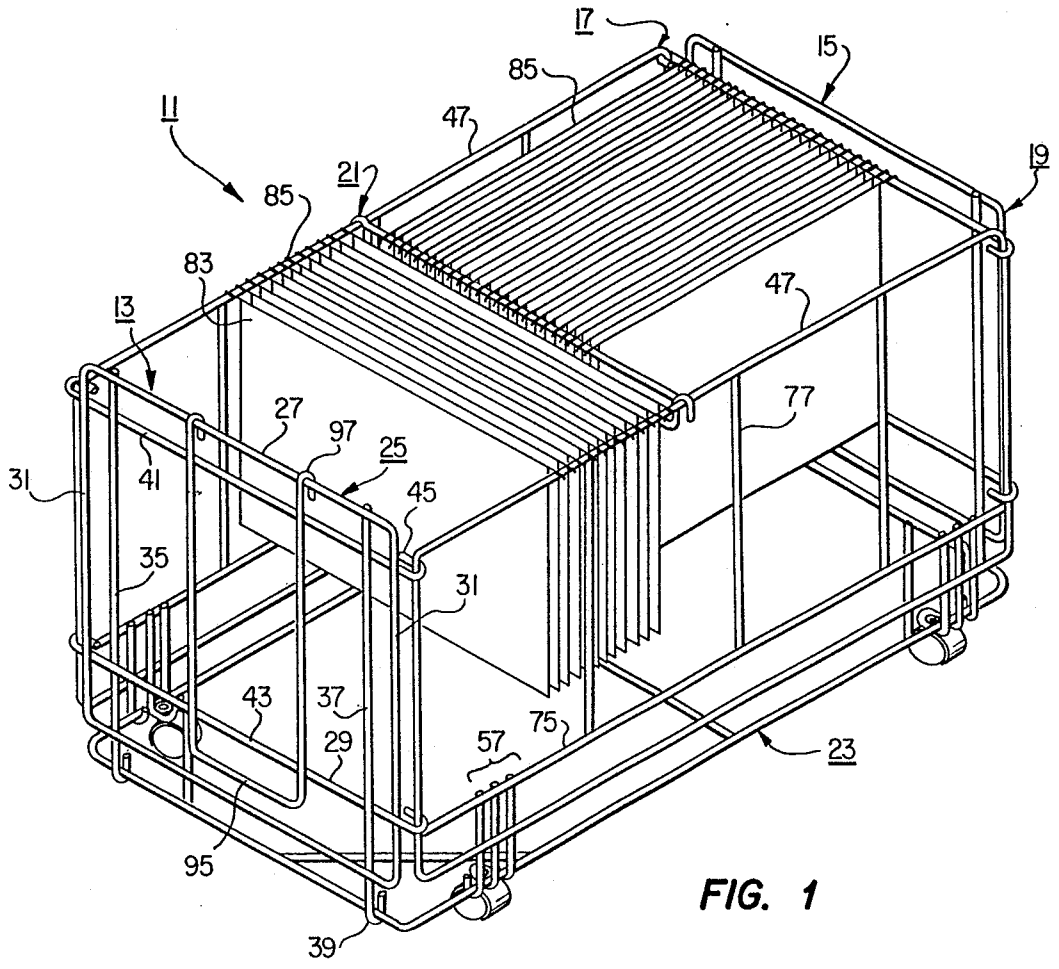
FIG. 1 is an isometric view of one embodiment of this invention illustrating one use for which the collapsible wire rack can be employed.
Figure 2:
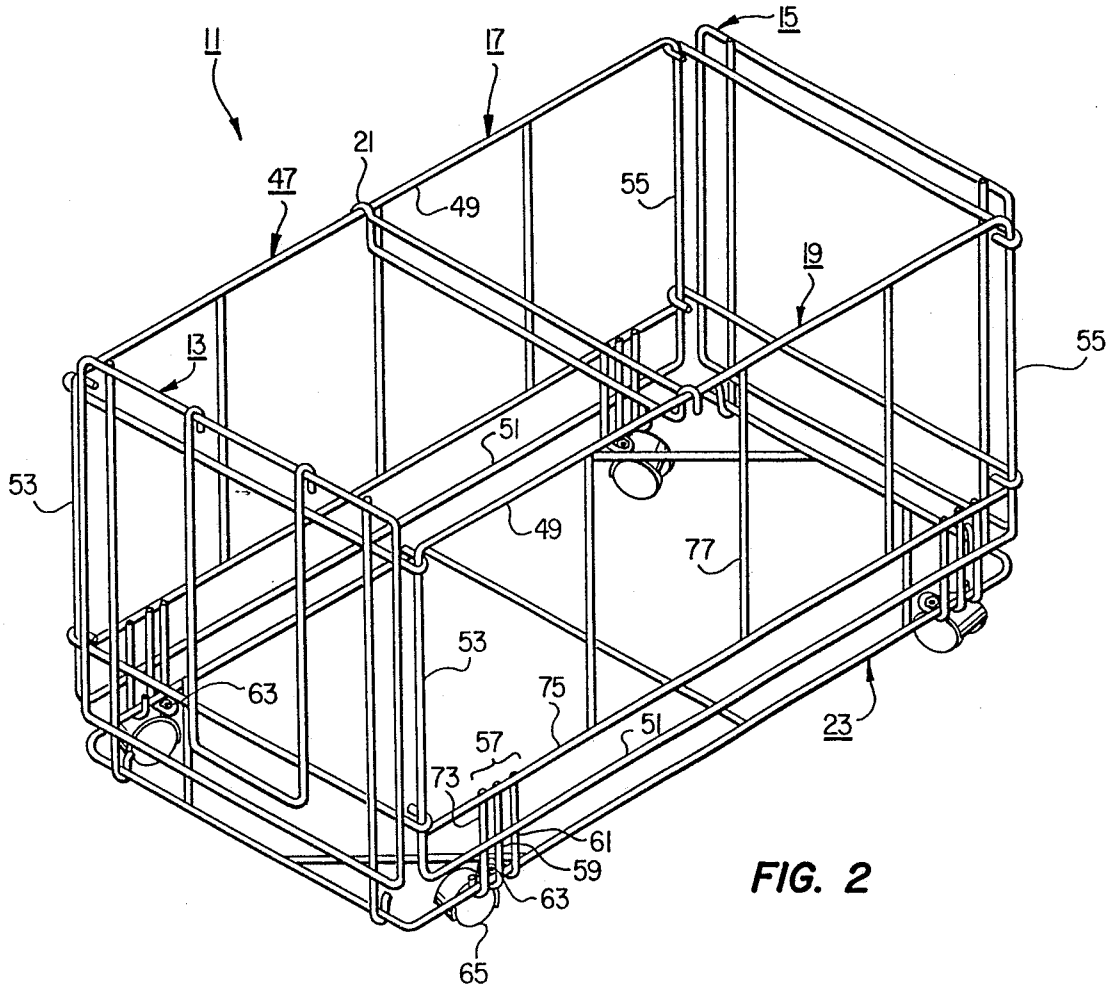
FIG. 2 is, an isometric view of the empty wire rack.
Figure 3:
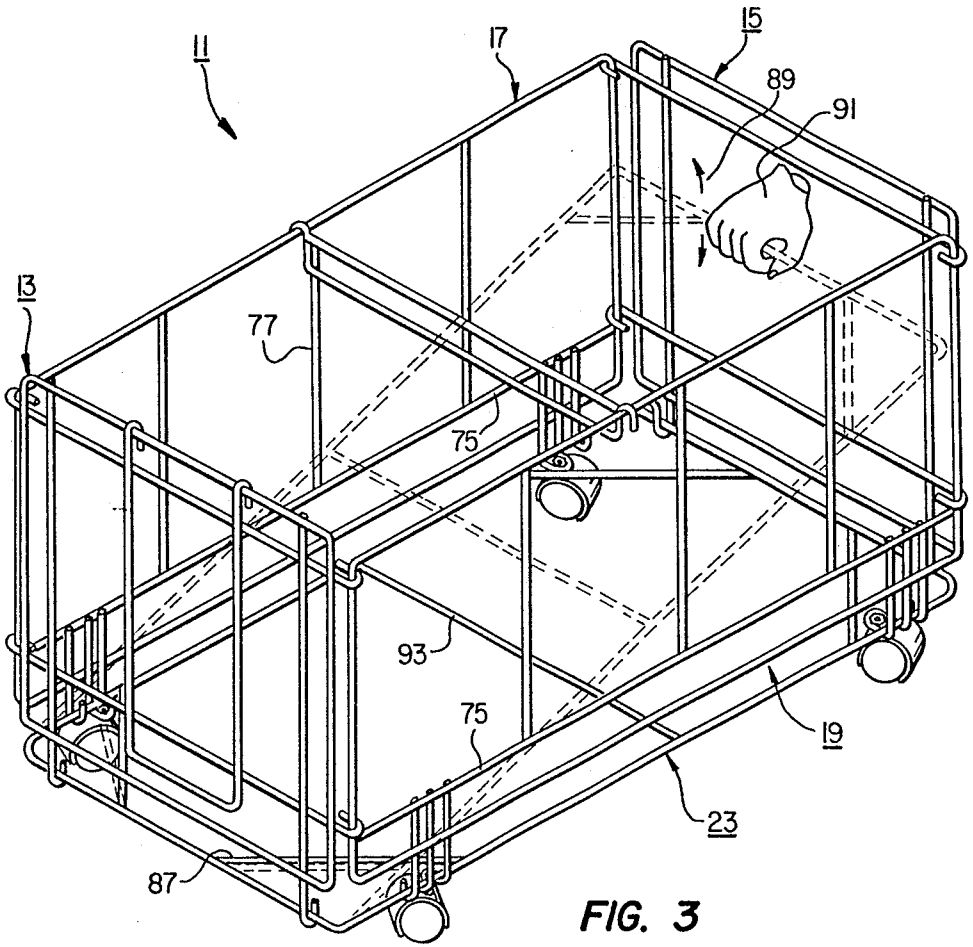
FIG. 3 is an isometric view illustrating the insertion, and/or removal of the bottom of the collapsible wire rack.

Referring to FIG. 1, the collapsible wire rack 11 comprises two substantially identical ends 13, 15; two substantially identical sides 17, 19, at least one divider 21 that is adjustable and removable and that has at each end a bent hook structure for hooking over a top wire such as the top of respective side 17 or 19, for suspendingly holding in place a computer printout or the like; and a bottom 23, FIGS. 1–3.

Each end such as end 13 includes a rectangularly shaped centerpiece 25, FIG. 1, that has joined together two horizontal wire members 27, 29 and two vertical wire members 31, 33. In the illustrated embodiment, the wire members are chrome-plated wires of three (3) gauge steel and are bent into the rectangular configuration, and joined, as by spot welding. The bending is done by a machine and need have only one set of controls if computer controlled to effect the bending of the respective ends. Expressed otherwise, it was as if a single template could be used for making all the end pieces.

Figure 4:
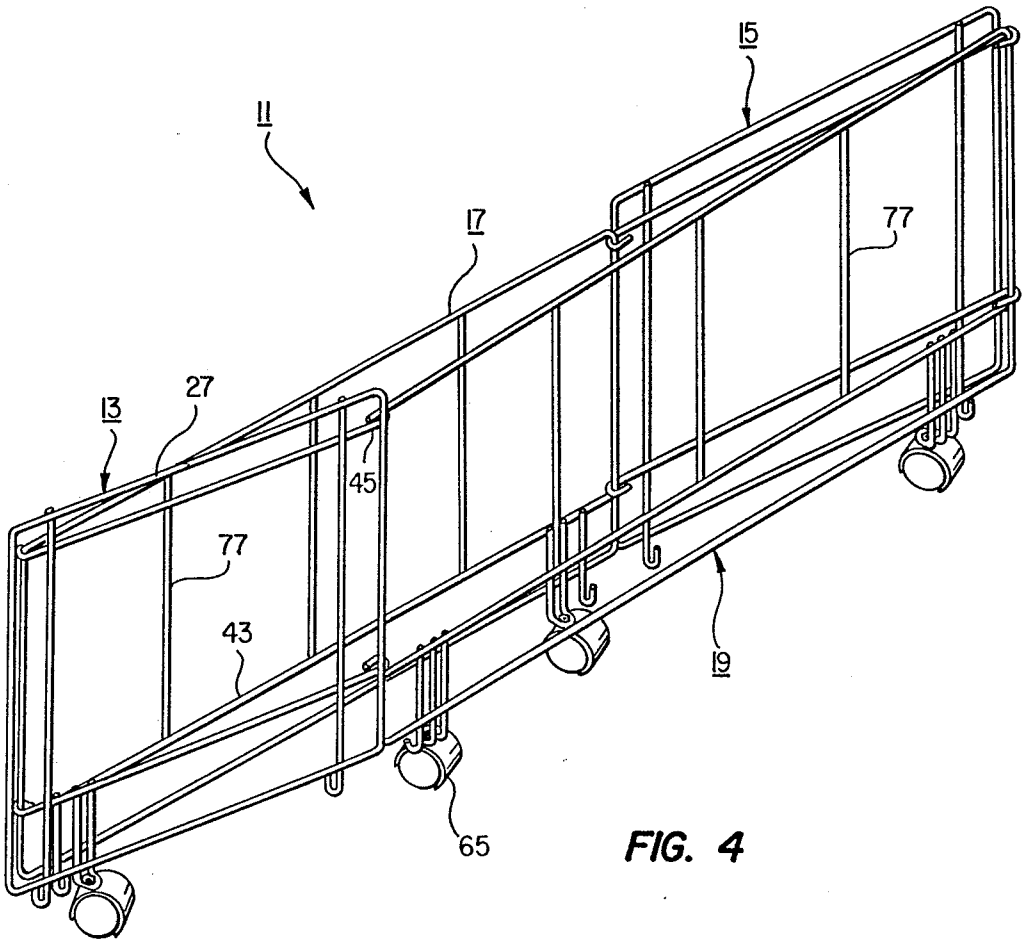
FIG. 4 is a perspective view of the collapsible wire rack in the collapsed position.

Each of the ends also have a pair of substantially vertical wire members 35, 37, that are affixed as by spot welding, to the rectangular centerpiece. The two vertical wire members 35 and 37 are formed of chrome-plated three gauge wire and have a bent hook structure 39 at their lower ends for receiving a bottom 23. Each end such as end 13 also includes a pair of horizontal wire members 41, 43 having at both ends thereof a bent hook-eye structure 45 for pivotally receiving respective side end wire members to allow collapsibility. The horizontal wire members 41, 43 are affixed, as by spot welding, to the other elements of the end, such as the rectangularly shaped centerpiece, or the vertical members 35, 37, or both. The bent hook-eye structure pivotally receives one of the side end vertical wire members to allow collapsibility through the pivotal movement, as illustrated in FIG. 4.

In the embodiments described herein, it is preferable to employ three gauge wire that is chrome-plated and is formed of steel or the like, although other wire such as aluminum wire could be employed if desired. The steel wire is easy to work with and has adequate structural strength. It may be necessary to employ somewhat large wire if other materials such as aluminum or magnesium are employed. The magnesium is not a preferred material of constructions, since even though structurally strong enough, it is brittle and prone to breakage, lacks ductility and is flammable in the case of a fire. Of course more exotic materials such as tungsten or even the composite materials could doubtless be employed in this invention, although they have not been investigated since the steel wire is so satisfactory. 2 gauge (or gauge) wire can be employed in this invention, particularly where structural strength is desired. As is recognized, 3 gauge wire has an outside diameter of about 0.259 inch whereas 2 gauge wire has an outside diameter of about 0.284 inch.

The sides can be seen more clearly perhaps in FIG. 2, so they will be delineated with respect to FIG. 2. The substantially identical sides 17, 19, each are formed of wire such as a three gauge wire delineated hereinbefore, except where a larger gauge is employed, such as two gauge wire for additional strength. Each of the sides 17 and 19 has a rectangularly shaped centerpiece 47 comprising joined together horizontal wire members 49, 51 and vertical wire members 53, 55. The upper horizontal wire member 49 forms a supporting top onto which the respective hangers, such as divider 21, are suspended. As described hereinbefore with respect to the ends, the rectangularly shaped centerpieces are bent by a machine which has only to follow a single simple rectangularly shaped bend in accordance with a computer program or the like. This is equivalent to a simple template for each of the sides, since they are substantially identical. The free wire ends are then welded together, or otherwise affixed together with suitable strength. Each side such as side 17 includes two sets, such as set 57, of three shortened vertical wire members; arranged at, or adjacent, the end of each side. Two of the wire members of a set, such as the wire members 59 and 61, are bent in a U-shaped configuration for carrying a nut 63 for screwingly, removably receiving a threaded shaft of a caster 65. For example, the nut 63 may be a T-nut welded into the wire loop. The nut 63 is threaded to receive the threaded shaft of a caster as will become apparent from examining FIG. 6.

Figure 6:
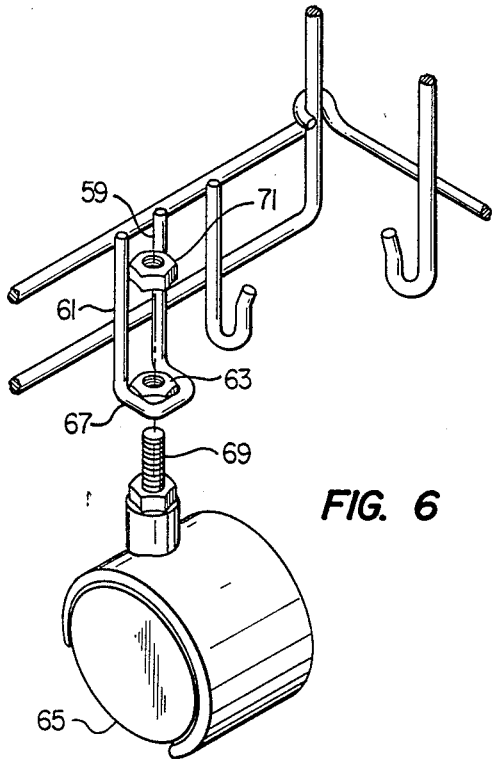
FIG. 6 is a partial isometric, partly exploded, illustrating the attachment of a caster with its threaded shaft bolt.

Referring to FIG. 6, the two wires 59, 61 are bent into the U-shaped configuration 67 and the T-nut 63 is welded in the bend of the wire. Thereafter, a threaded shaft such as shaft 69 of the caster 65 can be threadedly received therein. A cap nut, 71 can be employed to lock the threaded shaft into position, once the correct height has been achieved.

Figure 5:
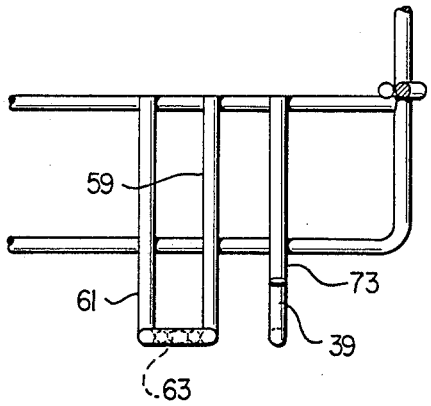
FIG. 5 is a partial side view of a set of the three vertical each end of each side.

The other wire 73 of the set has a bent hook structure at its lower end that is level with the bent hook structure of the ends for receiving the bottom 23. The three wires can be seen in the partial side view of FIG. 5. The three shortened wires 59, 61 and 73 are affixed, as by welding, to the elements of the side, such as the rectangularly shaped centerpiece, alone or in conjunction with being affixed, as by welding, to a two gauge horizontal wire member 75, FIG. 1. The longitudinally extending horizontal wire member 75 can also be affixed as by welding, to the rectangulary shaped centerpiece for structural strength. Additional vertical supporting wire members 77 may be affixed, as by spot welding, to the top and the horizontal longitudinally extending wire member 75.

Figure 7:
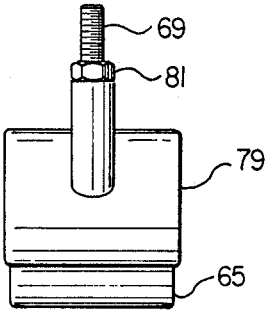
FIG. 7 is a front elevational view of a caster that is satisfactory for the embodiment of FIG. 6.

Referring to FIG. 7, the caster 65 is of a form that has broad inner area for relatively large tracking area and a couple of smaller diameter side protrusions 79. The threaded shaft 69 at the top is freely pivotally, or rotatably connected such that the nut 81 can be rotated to screw the threaded shaft into the nut 63 and retain it in place if screwed all the way up. On the other hand, the cap nut 71, FIG. 6, can be employed to lock at a given level other that screwed all the way up. Of course, other lock nuts can be employed if desired.

The divider 21 may be formed of two gauge metal or the like. If desired, a plurality of hangers can be employed, although ordinarily it is not necessary for each hanger to be as large, as the two gauge wire divider if only individual computer printouts 83 are to be hung thereon. Specifically, as can be seen in FIG. 1, lesser diameter top filing apparatus, or wires 85 can be employed. If desired, as can be seen in FIG. 1 also, the suspending wires 85 can be employed laterally or longitudinally and hung over an appropriate top wire of either the end and a divider 21; or over the side wires 47.

The bottom 23, FIG. 3, has sufficient diagonals, such as diagonal gussets 87, to impart rigidity to the collapsible wire cage once the bottom is emplaced. On the other hand, when the bottom is pulled upwardly, as illustrated by the arrows 89 adjacent the hand 91, the remaining frame can be collapsed, without or without removal of the casters 65.

In addition, the bottom may have a laterally extending member 93 to impart additional strength and rigidity. Each of the gussets in the member 93 are welded at each of their respective ends where they contact the end members such as the rectangular piece of which the bottom 23 is formed.

The bottom 23 as well as the diagonal gussets 87 and the laterally extending member 93 are preferably formed of suitable chrome plated steel wire, such as three gauge wire for the requisite rigidity. When the bottom is removed, the collapsible wire rack can be collapsed as illustrated in FIG. 4.

Adjacent each end there is provided a handle 95. To facilitate manufacture, the handle has a simple bent end structure 97 that can be hooked onto the top wire of its respective end. If desired, a handle may be provided at each end.

Although this invention has been described with a certain degree of particularity, it is understood that the present disclosure is made only by way of example and that numerous changes in the details of construction and the combination and arrangement of parts may be resorted to without departing from the spirit and the scope of the invention, reference being had for the latter purpose to the appended claims.

What is claimed is:

1. A collapsible wire rack for holding computer printout and the like comprising in an operational positional:

a. two substantially identical ends, each being substantially planar and formed of covered wire and including:

i. a rectangularly shaped center piece having joined together two horizontal wire members and two vertical wire members;

ii. a pair of substantially vertical wire members having a bent hook structure at their respective lower ends for receiving a bottom; said vertical wire members being affixed to said rectangular shaped center piece at each crossing of said horizontal wire members and being adapted to removably receive said bottom;

iii. a pair of said horizontal wire members having at both ends thereof a bent hook-eye structure for pivotally receiving a respective said end wire member to allow collapsibility, said horizontal wire members being connected with said end;

b. two substantially identical sides, each being substantially planar and formed of covered wire and including:

i. an elongate rectangularly shaped center piece having joined together two horizontal wire members and two vertical wire members; and having an upper, more elongate member defining a supporting top;

ii. two sets arranged one at each end of each side of three shortened vertical wire members, two of each set being bent in a U-shaped configuration for carrying a nut means for screwingly, removably receiving a threaded shaft of a caster; and one of each set having bent hook structure at its lower end and disposed substantially with said bent hook structure of said vertical wire member of each said end for receiving said bottom; said sets of three shortened wire members being connected with said side;

iii. a plurality of substantially horizontal wire members connected with said elongate rectangularly shaped center and said respective sets adjacent each end without interfering with the collapsibility of said wire rack;

c. a plurality of adjustable and removable cross members that each have at each end a bent hook structure for hooking over said top to suspendingly hold in place a computer printout or the like;

d. a bottom comprising an elongate rectangular covered wire structure adapted to removably fit interiorly of said ends and sides in normal operation and be received within said bent hook structure of said vertical wire members; said wire having sufficient diagonal bracing to impart rigidity to said collapsible wire rack when in place and to be removed to allow said wire rack to be collapsed for shipping, storing and the like.

2. The collapsible wire rack of claim 1 wherein said wire is within the range of two or three gauge wire.

3. The collapsible wire rack of claim 2 wherein the majority of said wire is about three gauge.

4. The collapsible wire rack of claim 1 wherein casters with threaded shafts are provided such that casters can be screwed into the respective nut means to facilitate portability.

5. The collapsible wire rack of claim 4 wherein a handle means is provided at each end to facilitate portability.

6. The collapsible wire rack of claim 1 wherein said bottom has a support wire extending laterally thereacross near its midsection for support.

7. The collapsible wire rack of claim 1 wherein a sliding divider is provided with respective hooks at each end for hooking over the top of each said side and being moved longitudinally of each said side.

8. The collapsible wire rack of claim 1 wherein the respective ends have a respective top wire serving as an end band and formed of two gauge wire and wherein each said side has a plurality of vertically extending wires that are affixed, as by welding; that are formed of two gauge wire and wherein a two gauge wire extends longitudinally of each said side; and is connected with said vertically extending wires for structural strength and is in the form of two gauge wire that is connected with the vertical members of said sides.

9. The collapsible wire rack of claim 1 wherein said wire is chrome-plated.

* * * * *